US010619952B2

(12) United States Patent
Köcher et al.

(10) Patent No.: US 10,619,952 B2
(45) Date of Patent: Apr. 14, 2020

(54) METHOD FOR OPERATING A HEAT EXCHANGER SYSTEM AND HEAT EXCHANGER SYSTEM

(71) Applicant: GÜNTNER GMBH & CO. KG, Fürstenfeldbruck (DE)

(72) Inventors: Jörg Köcher, Utting (DE); Ulrich Ziegltrum, München (DE)

(73) Assignee: GUENTNER GMBH & CO. KG, Fuerstenfeldbruck (DE)

( * ) Notice: Subject to any disclaimer, the term of this patent is extended or adjusted under 35 U.S.C. 154(b) by 239 days.

(21) Appl. No.: 15/515,444

(22) PCT Filed: Sep. 23, 2015

(86) PCT No.: PCT/EP2015/071813
§ 371 (c)(1),
(2) Date: Mar. 29, 2017

(87) PCT Pub. No.: WO2016/058795
PCT Pub. Date: Apr. 21, 2016

(65) Prior Publication Data

US 2017/0261274 A1 Sep. 14, 2017

(30) Foreign Application Priority Data

Oct. 13, 2014 (EP) ..... 14188678

(51) Int. Cl.
*F28F 27/00* (2006.01)
*F28B 11/00* (2006.01)
(Continued)

(52) U.S. Cl.
CPC ..... *F28F 27/00* (2013.01); *F28B 11/00* (2013.01); *F28D 3/00* (2013.01); *F24F 11/56* (2018.01)

(58) Field of Classification Search
CPC .. F24F 11/00; F24F 11/50; F28F 27/00; F28B 11/00; F28D 3/00; F25B 25/00; F25B 27/00; F25B 49/00
(Continued)

(56) References Cited

U.S. PATENT DOCUMENTS 3,716,097 A 2/1973 Kelp et al.
6,047,555 A 4/2000 Weng
(Continued)

FOREIGN PATENT DOCUMENTS

DE 1962061 A1 2/1972
DE 2220167 A1 11/1973
(Continued)

OTHER PUBLICATIONS

International Search Report dated Dec. 14, 2015 in corresponding International Application No. PCT/EP2015/071813, filed Sep. 23, 2015 (with English Translation).
(Continued)

*Primary Examiner* — Keith M Raymond
*Assistant Examiner* — Gustavo A Hincapie Serna
(74) *Attorney, Agent, or Firm* — Global IP Counselors, LLP

(57) ABSTRACT

A method of operating a heat exchange system includes a heat exchanger including an outer boundary formed by inflow and outflow surfaces, a fan configured and arranged such that a transport fluid is transported through the heat exchanger over the inflow surface to the outflow surface and a control unit that receives one or more actual values from the heat exchanger and/or fan in the operating state and that one or more predetermined values of the heat exchanger and/or of the fan are adjusted by the control unit. The heat exchange system further includes a communication module in signal communication with the control unit, the commu-
(Continued)

nication module receiving one or more actual values from the control unit and/or one or more predetermined values transmitted from the communication module to the control unit, with the communication module being in signal communication with a communication unit at least at times.

16 Claims, 2 Drawing Sheets

(51) Int. Cl.
*F28D 3/00* (2006.01)
*F24F 11/56* (2018.01)

(58) Field of Classification Search
USPC ..... 165/200, 201, 253, 254, 287, 289; 62/132, 157, 158
See application file for complete search history.

(56) References Cited

U.S. PATENT DOCUMENTS 8,393,169 B2 * 3/2013 Pham ..... F25B 49/005 62/127
8,590,325 B2 * 11/2013 Pham ..... F25B 49/005 62/129
8,700,444 B2 * 4/2014 Singh ..... G06Q 50/06 705/7.35
9,017,461 B2 * 4/2015 Kates ..... F24F 3/1603 96/421
9,285,802 B2 * 3/2016 Arensmeier ..... G05B 23/0224
9,410,752 B2 * 8/2016 Wallace ..... F28F 27/00
9,506,678 B2 * 11/2016 Uselton ..... F25B 45/00
9,638,436 B2 * 5/2017 Arensmeier ..... G05B 15/02
9,759,466 B2 * 9/2017 Goel ..... F24F 11/30
9,945,387 B2 * 4/2018 Balistreri ..... F04D 19/002
2002/0020175 A1 * 2/2002 Street ..... F25B 49/02 62/132
2006/0254294 A1 * 11/2006 Shimamoto ..... F24F 3/065 62/238.7
2009/0101726 A1 * 4/2009 Rankich ..... G05D 23/1905 236/51
2010/0101770 A1 * 4/2010 Thogersen ..... F25D 29/003 165/246
2012/0158189 A1 6/2012 Cho et al.
2012/0186774 A1 * 7/2012 Matsuoka ..... F24F 11/30 165/11.1
2012/0248210 A1 * 10/2012 Warren ..... G05D 23/1902 236/1 C
2013/0289777 A1 10/2013 Koizumi et al.
2014/0074730 A1 * 3/2014 Arensmeier ..... G06Q 10/20 705/305
2014/0223956 A1 8/2014 Lee et al.

FOREIGN PATENT DOCUMENTS

DE 19925970 A1 12/2000
EP 0220607 A1 5/1987
EP 2187141 A2 5/2010
EP 2613100 A1 7/2013
EP 2787299 A1 10/2014
WO 2011033444 A1 3/2011

OTHER PUBLICATIONS

Dierks G. "Luftgekuhlte Ruckkuhlsysteme", Kaelte Und Klimatechnik, XP003028167, Mar. 1, 2000, pp. 1-8.

* cited by examiner

METHOD FOR OPERATING A HEAT EXCHANGER SYSTEM AND HEAT EXCHANGER SYSTEM

CROSS-REFERENCE TO RELATED APPLICATIONS

This application is a U.S. National Stage application of International Application No. PCT/EP2015/071813, filed Sep. 23, 2015, which claims priority to EP Application No. 14188678.8, filed Oct. 13, 2014 the contents of each of which are hereby incorporated herein by reference.

BACKGROUND

Field of Invention

The invention relates to a method of operating a heat exchange system and to a heat exchange system Background Information Methods of operating a heat exchange system and heat exchange systems are already known and can be found in a plurality of technical applications. Heat exchange systems are used in refrigeration plants such as in common domestic refrigerators; in air-conditioning systems for buildings or in vehicles of all kinds, above all in motor vehicles, in aircraft and in ships; as water coolers or as oil coolers in combustion engines; as condensers or as evaporators in refrigerant circuits; and in further innumerable different applications which are all well-known to the skilled person.

In practical use, a heat exchange system comprises at least one heat exchanger and one fan. The heat exchanger is in this respect connected to a circuit which contains a heat transfer fluid, i.e. a heat transfer medium, for example a coolant, with the heat exchanger taking up or transferring heat. The heat transfer fluid can in this respect be a coolant, water, water with glycol or a gas, for example ammonia or $CO_2$. The transport fluid outside the heat exchanger, e.g. water, oil or frequently simply the environmental air, can take up thermal energy from the heat exchanger or transfer it to the heat exchanger and is therefore either correspondingly heated or cooled in this respect. The transport fluid usually has a substantially lower heat transfer coefficient than the heat transfer fluid circulating in the heat exchanger.

This is compensated by very different heat transfer surfaces for the two media. The heat transfer fluid having the high heat transfer coefficient therefore flows in a pipe or in an extruded section which, on the outer side, has a greatly enlarged surface due to one or more ribs or fins, for example sheet metal parts, at which surface the heat transfer takes place with the transport fluid, for example with the environmental air.

One possibility of sensibly classifying the heat exchangers consists of making a distinction based on the design and/or the manufacture of the different types of heat exchangers.

A widespread embodiment is the fin heat exchanger. In the simplest case, a fin heat exchanger comprises a pipe for conducting the heat transfer fluid and a plurality of fins which are connected to the pipe and which are in communication with a transport fluid in operation. The fin heat exchanger is particularly expedient when the transport fluid is gaseous and comprises environmental air since the latter has a comparatively low heat transfer coefficient which can be compensated by a correspondingly large surface of the fins.

The manufacture of these so-called fin heat exchangers takes place in accordance with a standardized process which has long been known: The fins are stamped using a press and using a special tool and are laid in packets with respect to one another. The pipes are subsequently pushed in and widened either mechanically or hydraulically so that a very good contact, and thus a good heat transfer, arises between the pipe and the fin. The individual pipes are then connected to one another, frequently soldered to one another, by bends and manifolds.

A heat exchange system and methods of operating a heat exchange system are known from WO 2011/033444 A1, wherein one or more actual values of the heat exchange system are received and/or wherein one or more desired values of the heat exchange system are adjusted by a control unit. The control unit can in this respect, for example be in signal communication with one or more sensors and/or actuators of the heat exchange system, for example sensors and actuators at the heat exchanger or at a fan of the heat exchange system. An actual value of a sensor can be received by the control unit in this respect, the actual value can be compared with a desired value by the control unit and the desired value can be adjusted at an actuator by the control unit.

SUMMARY

It is a disadvantage of this method and of the heat exchange system that one or more desired values have to be adjusted at the control unit prior to the putting into operation of the heat exchange system and a change of a desired value has to be carried out directly at the control unit by a technician or engineer. The adjustment of one or more desired values or the reading out of one or more actual values is equally satisfied in a very disadvantageous, complex and/or expensive manner. For this purpose, either corresponding hardware or a display, which enables a display or an input of an actual value, has to be attached to the heat exchange system or the heat exchange system, in particular the control unit, has to be wired in a very complex and/or expensive manner to a building services management system at the location of installation. After the installation and the putting into operation, changes of the adjustment of a desired value, of an operating mode or of a function but also the reading off/reading out of an actual value or the carrying out of remote servicing are, frequently for construction reasons alone, awkward and thus complex and/or expensive using the known methods and known heat exchange systems, for example because the heat exchange system is not easily directly accessible in the installed state. With known heat exchange systems it can, for example be necessary to open a housing in order e.g. to make changes to an adjustment of the control unit. The opening of the housings is in this respect not only complex and/or expensive and awkward, but even impossible in part. The heat exchange systems then, for example, have to be taken out of operation since an opening of the housing of the heat exchange system is otherwise not allowed for safety reasons alone or is not possible at all in the operating state for technical reasons.

A heat exchange system, e.g. a cold store or a supermarket, frequently also has to be correspondingly reachable, that is adjusted, immediately because, e.g. a refrigerated product spoils after a short time or a building immediately heats up to unacceptable temperatures. A technical expert is not always available. The service personnel, for example a technician or a graduate engineer, is underway in many cases and cannot be on site quickly to service the heat exchange system of a client. However, in the case of an emergency, a fast response is necessary which is not possible with the known installations. Personnel therefore frequently have to be recruited on site in a very complex and/or expensive manner and at more expensive terms.

It is therefore an object of the present invention to propose a method of operating a heat exchange system and a heat exchange system which is simple and inexpensive and which in particular enables a simple servicing, adjustment and remote analysis of a heat exchange system. It is therefore also an object to provide access to the heat exchange system to service personnel who are far away and who are not available at all on site, and indeed from everywhere, even from where no corresponding technical devices are provided, for example such as at an airport, etc.

This object is satisfied by a method of operating a heat exchange system having the features described herein and by a remote heat exchange system described herein.

In accordance with the invention, a method of operating a heat exchange system is proposed comprising a heat exchanger, wherein an outer boundary of the heat exchanger is formed by an inflow surface and by an outflow surface such that, in the operating state, for the exchange of heat between a transport fluid and a heat transfer fluid flowing through the heat exchanger, the transport fluid is supplied to the heat exchanger over the inflow surface, is brought into flow contact with the heat exchanger and is led off again out of the heat exchanger over the outflow surface; a fan which is configured and arranged such that the transport fluid is transported through the heat exchanger over the inflow surface to the outflow surface; a control unit, in particular a control unit having a data processing system, is provided so that, in the operating state, the control unit receives one or more actual values from the heat exchanger and/or fan and one or more desired values of the heat exchanger and/or of the fan are adjusted by the control unit. The heat exchange system comprises a communication module, wherein the communication module is in signal communication with the control unit and the communication module receives one or more actual values from the control unit and/or one or more desired values are transmitted from the communication module to the control unit, with the communication module being in signal communication with a communication unit at least at times.

The heat exchanger can be a fin heat exchanger which can, for example comprise a plurality of pipes for conducting the heat transfer fluid and a plurality of fins. The fins can in this respect be connected to the pipes and are in communication with the transport fluid in operation. The fins or pipes can be composed of a material with good heat conductivity, for example aluminum or copper or stainless steel. The fin heat exchanger can naturally also include a plurality of pipes for more than one heat transfer medium or the pipes can be connected to one another in parallel and/or in series as required. However, the heat exchanger can also be a microchannel heat exchanger. The heat exchanger can be designed as a heat exchanger having fins which are all formed together. The heat exchanger can be operated in a thermal power range of 5 kW to 5,000 kW, preferably 10 kW to 2,000 kW. In addition, the heat exchange system having the described heat exchanger can be used in commercial or industrial applications, for example, cold stores, office buildings, warehouses, computer centers, industrial plants, etc. Private households, that is single-family houses, do not form an area of application of the method or of the heat exchange system. The heat exchanger can be a condenser for applications inside buildings or outside buildings, a cooler for applications outside buildings or an air cooler for applications inside buildings, each having a glycol-water mixture as a heat transfer fluid or having a condenser for applications inside buildings.

The fan is configured and arranged such that the transport fluid is transported through the heat exchanger over the inflow surface to the outflow surface. The number of rotations of the fan can be received by a control unit which can be in signal communication with the fan and which can adjust the fan. However, the control unit can equally also be in signal communication with the fan and can adjust the fan.

The control unit can be a controller or a control device, in particular having a data processing system, able to control and regulate, or can also be a programmable memory element with a fixedly programmable function. One or more actual values can be received from the heat exchange system, in particular from the heat exchanger and/or fan and/or environment, by the control unit and one or more desired values of the heat exchanger and/or of the fan can be adjusted by the control unit. One or more actual values and/or desired values can therefore be received and transmitted by the control unit, one or more desired values can be adjusted and technical calculations can be carried out. By using the control unit, actual values can, for example be received from one or more sensors with which the actual values are, for example measured or calculated. The control unit can, however, also receive further actual values, for example from further sensors or from a further control unit. By using the control unit, however, desired values can also be transmitted, for example to one or more actuators with which the desired values are adjusted, that is controlled and regulated. One or more desired values can, however, also be transmitted to further actuators or to a further control unit by the control unit.

The control unit can be configured as a part of the heat exchange system or of the heat exchanger; that is it can, for example be fastened inside or outside a housing of the heat exchange system or of the heat exchanger, or it can, for example be arranged inside a room or inside a switch cabinet. The control unit can be in signal communication with a sensor or with an actuator or with a further control unit and can communicate, for example by a cable or preferably wirelessly, for example via radio.

To adjust, is in this respect to be understood as to control and to regulate. To control is to be understood such that, for example, an operating mode and/or a desired value and/or a function of the heat exchange system, in particular of the heat exchanger and/or of the fan, can be varied by the control unit, preferably by the communication unit. To regulate is to be understood such that actual values can, for example, be detected or measured by a sensor and such that a calculated or predefined desired value, which can therefore be a setting value for the control unit, for example a number of rotations or a condensation temperature, can be adjusted and influenced.

The heat exchange system comprises a communication module, wherein the communication module is in signal communication with the control unit and the communication module receives one or more actual values from the control unit and/or one or more desired values are transmitted from the communication module to the control unit. Signal communication can in this respect be understood as a link for the exchange of data, in particular of actual values and of desired values. The communication module and the control unit can be connected to one another by a cable or a wire or also wirelessly, that is, for example by radio. The communication module can be formed as a radio module, for example a WLAN module or a Bluetooth module or a ZigBee module or an EnOcean module, or as a connector for a wire, for example for a cable or for a LAN cable. One or more actual values can be received from the control unit and desired values can be transmitted to the control unit by the communication module. In addition, actual values and desired values can be transmitted to a communication unit by the communication module for the representation of an actual value and for the adjusting of a desired value and can be received by said control unit, in particular wirelessly. The communication unit can be a smartphone, a tablet, a laptop or a stationary computer. The communication unit can, for example be connected to the communication module by a cable or by radio. At least at times is to be understood in this respect such that the communication unit and the communication module are only in signal communication with one another for a limited period of time for the receiving and/or for the transmission and/or for the adjusting of an actual value and/or of a desired value. The communication unit and the communication module can, however, also be in permanent signal communication with one another.

It is an advantage of this method that hardware or a display at the control unit can be dispensed with for this purpose and an actual value can nevertheless be represented and a desired value, an operating mode or a function can be adjusted. The wireless access furthermore offers the advantage that the control unit can transmit, receive and adjust an actual value and/or a desired value by the communication module at a certain distance from the heat exchange system. A change, a adjusting and remote analysis of the actual value and of the desired value, in particular also updates, and remote servicing of the heat exchange system, preferably at heat exchange systems which are difficult to access, in particular in cold stores or on roofs, thus also become possible.

In an embodiment of the invention, the communication unit receives operating data in the form of one or more actual values from the communication module. One or more desired values are equally adjusted at the communication unit and one or more desired values are transmitted from the communication unit to the communication module.

Since the communication module is in signal communication with the control unit and the communication module is in signal communication with the communication unit, one or more actual values can be received from the communication module by the control unit and the communication unit can in turn receive one or more actual values from the communication module. In other words, one or more actual values are transmitted from the control unit to the communication module and subsequently to the communication unit. Conversely, however, since the control unit, the communication module and the communication unit are in signal communication, one or more desired values can also be adjusted at the communication unit and one or more adjusted desired values transmitted to the communication module can subsequently be transmitted from the communication module to the control unit. Hardware or a display at the heat exchange system, in particular at the control unit, can thus advantageously be dispensed with and the heat exchange system can thus be manufactured less expensively. A suitable representation of actual values and an adjustment of desired values at the communication unit as well as a transmission of the desired values from the communication unit to the communication module is possible at the same time.

In an embodiment of the invention, the communication module is formed as a unit of the control unit. The communication module and the control unit can therefore be formed in one part, and can in particular be designed as one unit from a construction aspect. One unit from a construction aspect can in this respect be understood as a control unit which comprises a constructionally and electronically integrated communication module. The control unit can thus advantageously be manufactured in a simple and inexpensive manner.

In an embodiment of the invention, the communication unit is in wireless signal communication with the communication module. The communication module and the communication unit can be in wireless signal communication; that is they can in particular be connected to one another by radio, for example by WLAN or Bluetooth or ZigBee or EnOcean. The wireless signal connection offers the advantage that actual values and desired values can be transmitted, received and adjusted at a certain distance from the heat exchange system, in particular from the control unit, which is particularly advantageous with heat exchange devices which are, for example located in cold stores or on roofs in a manner difficult to access. It is a further advantage that a direct wireless communication between the communication unit, in particular between mobile end devices or stationary end devices, for example a smartphone, a tablet or a laptop, and the control unit of the heat exchange system thus becomes possible.

In an embodiment of the invention, the communication module is in signal communication, in particular in wireless signal communication, with an access point and the communication unit is in signal communication, in particular in wireless signal communication, with the access point at least at times. The access point additionally receives one or more actual values from the communication module and one or more desired values are transmitted to the communication module and the communication unit receives one or more actual values from the access point and one or more desired values are adjusted at the communication unit and one or more adjusted desired values are transmitted from the communication unit to the access point. One or more actual values and/or desired values are stored at the access point.

The access point can be a central control unit, for example a network, in particular a wireless network having a server or a network device, for example a router. Since the communication module is in signal communication with the control unit, since the communication module is in signal communication with the access point and since the access point is in signal communication with the communication unit at least at times, one or more actual values can be received from the communication module by the control unit and the access point can in turn receive one or more actual values from the communication module and the communication unit can in turn receive one or more actual values from the access point when it is in signal communication with the access point. In other words, one or more actual values are transmitted from the control unit to the communication module and subsequently to the access point. The actual values can be stored there or can be transmitted to the communication unit and/or can be received by it.

Conversely, however, since the control unit, the communication module and the access point are in signal communication and the communication unit is in signal communication with the access point at least at times, one or more desired values can be adjusted at the communication unit and one or more adjusted desired values can be transmitted to the access point. One or more desired values can be stored at the access point and/or can be transmitted from the access point to the communication module and can be subsequently transmitted from the communication module to the control unit. The communication unit can, for example be connected to the access point by a cable or by radio. At least at times is in this respect to be understood such that the communication unit and the access point are only in signal communication with one another for a limited period of time for the receiving and/or for the transmission of an actual value and/or of a desired value and/or for the adjusting of a desired value. The communication unit and the access point can, however, also be in permanent signal communication with one another. The communication module, the access point and the communication unit can preferably be in wireless signal communication. The communication unit can thus advantageously carry out adjusting of desired values via the access point and via the communication module, in particular via a network, and can transmit said adjustments to the control unit. The control unit can in this respect, for example act as a client in the network and actual values and desired values can be transmitted to and/or received and/or stored at the access point via the network. Actual values can also be received, for example over a web service, from the access point by the communication unit and can be represented at the communication unit and desired values can be adjusted at the communication unit and/or can be transmitted to the access point. There is furthermore advantageously the possibility of receiving one or more actual values from the access point at the communication units which are not present in the network, for example via a remote access application, and conversely of adjusting the desired values at the communication unit and transmitting them to the access point. As already mentioned, hardware or a display at the heat exchange system, in particular at the control unit, can thus advantageously be dispensed with and the heat exchange system can thus be manufactured less expensively. At the same time, a suitable representation of actual values, adjusting of desired values at the communication unit and a transmission of the desired values from the communication unit to the communication module is possible. It is furthermore of advantage that the method makes it possible to adjust the actual values and the desired values of a heat exchange system independently of distance. Furthermore, the possibility of remote servicing and of remote analysis of the heat exchange system results hereby.

In an embodiment of the invention, the heat exchange system comprises a further heat exchanger, a further fan, a further control unit and a further communication module, wherein the further communication module is in signal communication with the access point and the access point receives one or more actual values from the further communication module and one or more desired values are transmitted from the access point to the further communication module. One or more actual values and desired values from a plurality of heat exchange systems can thus advantageously be adjusted at and/or transmitted to and/or received and/or represented at one or more communication units at the same time.

In an embodiment of the invention, the one or more desired values comprise

- a desired number of rotations for the fan; and/or
- a first desired temperature value for the heat transfer fluid; and/or
- a second desired temperature value for the transport fluid; and/or
- a desired time interval for an operating time of the heat exchange system; and/or
- an operating mode of the heat exchange system.

One or more actual values can, as already mentioned, be detected and/or measured by one or more sensors. One or more desired values can be adjusted at the communication unit and can be transmitted to the control unit via the access point and/or the communication module. The control unit can in turn store one or more desired values and/or adjust one or more actuators which are in signal communication with the control unit. One or more desired values can comprise a desired number of rotations for the fan and/or a first desired temperature value for the heat transfer fluid and/or a second desired temperature value for the transport fluid and/or a desired direction of rotation and/or a desired torque and/or a desired time interval for an operating time or for any other further desired value by which the heat exchange system can be adjusted. One or more desired values can, however, equally also comprise an operating mode. An operating mode can be understood as a combination of a plurality of desired values which are adjusted or also as a function which represents a flow chart of one or more of the same or different desired values which are adjusted one after the other. In the following, six embodiments of operating modes are described. However, further different operating modes can also be adjusted.

In a first operating mode of the heat exchange system, the desired torque can be varied section-wise and/or the desired direction of rotation of the fan can be varied, preferably section-wise. The desired torque can, however, also be increased successively up to a maximum value. The direction of rotation can equally be reversed and/or the desired torque can be increased after the desired direction of rotation has been reversed. The breaking free of a fan wheel is, for example made particularly easy thereby, in particular when the wheel of the fan is blocked by snow or by ice.

A second operating mode of the heat exchange system can, for example be an adjustment of the fan at a maximum desired number of rotations and the wetting of a wetting device with a maximum quantity of spray water. An operating mode can in this respect be derived by an actual value, for example, by a condensing temperature. In a first operating mode, a desired condensing value cannot be achieved due to a high environmental temperature and the heat exchanger can be operated in a full load operation.

In a third operating mode, the heat exchange system can be operated in a part load operation without an efficiency mode. The fan can in this respect be in regulated operation, i.e. the desired number of rotations can be adjusted to any desired number of rotations. In addition, the desired condensing value can be achieved. If the adjusted minimal condensing temperature has been achieved, the desired number of rotations of the fan can, for example be adjusted to a lower number of rotations than the maximum desired number of rotations in order to avoid a further fall of the condensing temperature. The wetting device can additionally be adjusted such that the heat exchanger is wetted with the calculated quantity of spray water, whereby the condensing temperature is lowered and the performance of the heat exchanger is increased by a cooling resulting therefrom.

In a fourth operating mode of the heat exchange system, a cost function can be calculated in dependence on a parameter and the heat exchange system can be adjusted such that the cost function is minimal. The third operating mode can be described as a part load operation with an efficiency mode. The fans can in this respect be in regulated operation, i.e. the desired number of rotations can be adjusted to a lower number of rotations than the maximum number of rotations. The desired condensing value can additionally be achieved. In the third operating mode, the quantity of spray water and the desired number of rotations are adjusted such that the cost function is calculated in dependence on a parameter and the heat exchanger is adjusted such that the cost function is minimal. The parameters can be the price of water and/or the price of electricity. The minimal cost function can thus, for example, be calculated with reference to predefined water costs and electricity costs and the most cost-efficient operating point of the heat exchanger can be adjusted. The heat exchanger is thereby operated in a very energy-efficient mode since the water costs and electricity costs are minimal.

In a fifth operating mode of the heat exchange system, a night setback of the heat exchange system can be adjusted. A night setback can in this respect be understood as a reduction of performance of the heat exchange system which has the advantage that the heat exchange system can be operated in a noise-reducing and energy-efficient manner.

An operating scheme for troubleshooting can be carried out in a sixth operating mode of the heat exchange system.

Provision can be made in further operating modes that an activation of a manual operation is provided, that is the presetting of a fixed desired number of rotations for the fan; or an activation of a servicing cycle when the heat exchange system is idle; or a cleaning cycle in which a fan runs backward; or a minimal load operation, wherein the heat exchange system is in an operation with a minimal energy consumption; or a desired value shift, wherein the desired value is adjusted, in particular shifted, for example into a free cooling mode which can be particularly energy-efficient.

It is a great advantage of the method in accordance with the invention that one or more actual values can be received and represented by the communication unit and that one or more desired values can be adjusted at the communication unit and the adjusted desired values, in particular different operating modes, can be transmitted to the control unit and taken over by it. Unnecessary costs can thereby be spared by the utilization of communication units which are present, adjustments do not have to be carried out directly at the heat exchange system; for example remote analysis and remote servicing, but also operating software (firmware) updates, can be adjusted through the communication unit via the access point and/or via the communication module at the heat exchange system, in particular through the control unit. A simple and inexpensive operation of the heat exchanger is thereby made possible by a simple method. The heat exchange system is thus improved overall in comparison with the prior art.

In an embodiment of the invention, the control unit comprises a PI regulator and one or more desired values comprise a regulating portion of the PI regulator. The heat exchange system additionally comprises a wetting unit and the control unit receives one or more actual values from the wetting unit in the operating state and one or more desired values are adjusted at the wetting unit by the control unit. One or more desired values can be adjusted, that is controlled, preferably regulated, by the PI regulator. The heat exchange system, in particular the heat exchanger or a wetting mat, can be wetted with a wetting fluid by the wetting device. The wetting fluid can form a drop-forming liquid film at the heat exchanger. The wetting device can be equipped with spray nozzles, wherein the spray nozzle can be a hollow cone nozzle, a flat jet nozzle or any other kind of nozzle, for example, which is suitable for wetting the heat exchanger. The wetting device can preferably be arranged at the inflow surface. The heat exchange system, in particular the heat exchanger, can be wetted by the wetting device for time intervals of the same or different lengths, in one or more sections and with different quantities of wetting fluid. A section can in this respect be understood as a bounded part region of the heat exchanger which is ventilated by a fan. A heat exchanger can in this respect comprise one or more sections which are spatially separated from another, for example by a separating wall, such that the transport fluid can be transported in a section by a fan. The heat exchange system can thus be operated with particularly optimum costs and economically and energy-efficiently.

In an embodiment of the invention, the fan is configured and arranged such that the transport fluid is sucked in over the inflow surface, is transported through the heat exchanger and is led off again out of the heat exchanger over the outflow surface. A flow of the transport fluid from the inflow surface to the outflow surface is thus advantageously achieved to the fan, which is particularly simply solved from a construction aspect and is energetically particularly favorable and is thus advantageous.

In an embodiment of the invention, the control unit and the further control unit are in signal communication, in particular in wireless signal communication. One or more actual values and desired values can in this respect be exchanged, that is transmitted or received or adjusted, between the control unit and the further control unit. A desired value can, however, equally also be adjusted at the further control unit by the control unit. An indirect adjusting of one or more desired values at the further control unit can thus advantageously be carried out by the control unit, that is a direct adjusting of one or more desired values at the further control unit can be dispensed with. One or more actual values of the further control unit can also be transmitted to the control unit and can be received from there by the communication unit.

In an embodiment of the invention, the heat exchange system comprises the heat exchanger, the control unit and the communication module and a further heat exchanger, a further control unit and a further communication module. The control unit and the further control unit and/or the communication module and the further communication module can be connected to one another in a signal communication, in particular can be at least intermittently and/or wirelessly connected to one another in a signal communication. The communication module can receive one or more actual values from the further communication module and/or the further communication module can receive one or more actual values from the communication module. The communication module can receive and/or transmit one or more desired values from the further communication module. Likewise the further communication module can receive and/or transmit one or more desired values from the communication module. Moreover, the communication module can be connected to the control unit in a signal communication and/or the further communication module can be connected to the further control unit in a signal communication. One or more actual values from the control unit and/or from the further control unit can be received by way of the communication module and the further communication module and desired values can be transmitted to the control unit.

In an embodiment of the invention, the communication unit receives operating data in the form of one or more actual values from the further communication unit or vice versa. Likewise one or more desired values are adjusted at the communication unit and one or more desired values are transmitted from the communication unit to the further communication unit.

Likewise a thermal maximum overall load can be predefined as a desired value for the heat exchange system. From this thermal maximum overall load of the heat exchange system a part load of the heat exchanger and a further part load of the further heat exchanger can be determined or calculated. The part load and the further part load can be adjusted at the heat exchanger and at the further heat exchanger as a desired value. In a normal mode of operation the part load and the further part load are of exactly equal magnitude and the sum of the part loads results in the overall load. Generally speaking, this means for N heat exchangers, the overall load is thus by way of example divided by N in such a way that the $N^{th}$ portion of the overall load results for each heat exchanger this means that the same part load results and can be adjusted as the desired value, for example each heat exchanger must make available half of the overall load for two heat exchangers, for three heat exchangers each heat exchanger has to make available a third of the overall load. The part load and the further part load can in particular be adjusted by the desired number of rotations of the fan and a further desired number of rotations of the further fan. Generally speaking the N part loads of N heat exchangers can respectively be adjusted with the desired number of rotations of the respective $N^{th}$ fan.

The heat exchange system can be operated in an outage mode of operation, with an outage mode of operation being able to be understood such that the heat exchanger is not operated for a certain interval in time, a time of standstill, in particular the fan has a desired number of rotations of 0, in contrast to which the further heat exchanger is operated during the time of standstill, with in particular the further fan having an increased desired number of rotations or a further increased volume flow in comparison to a normal mode of operation. An example for an outage mode of operation is a defrosting of the heat exchanger (a defrosting process), a maintenance of the heat exchanger (maintenance process), a cleaning of the heat exchanger (cleaning process) or also a failure of the heat exchanger (a case of failure). In the outage mode of operation the part load of the heat exchanger is adjusted to 0 (in words zero), in contrast to which the further part load of the further heat exchanger is adjusted to the overall load, in particular the desired number of rotations is adjusted to 0 and the further desired number of rotations is adjusted to a higher desired number of rotations in such a way that the further part load of the further heat exchanger corresponds to the overall load. During the time of standstill the overall load of the heat exchanger is thus advantageously performed by the further heat exchanger and can be maintained constant. It is of advantage that if the maximum thermal overall load is very large, a plurality of heat exchangers of the heat exchange system, in particular a plurality of heat exchanging devices (dry coolers) can be networked with one another or a plurality of condensers can be networked with one, in particular by the communication unit and of the further communication unit and information, this means actual values and/or desired values, can be transmitted, received and adjusted to one another in such a way that the maximum thermal overall load is reached, although the heat exchanger is not in the operating mode. During the time of standstill, in particular during the defrosting process, the maintenance process, the cleaning process or the failure, the missing part load of the heat exchanger is thus compensated by the further heat exchanger in such a way that the overall load of the heat exchanger is constant. The same is thus possible in the outage mode of operation for the N heat exchangers of the heat exchange system. If thus an $N^{th}$ heat exchanger having an $N^{th}$ partial load is taken out of operation, the $N^{th}$ partial load can be distributed to one or more of the N−1 other heat exchangers such that the overall load is reached.

A heat exchange system for the carrying out of the method in accordance with the invention is furthermore proposed in accordance with the invention in the following. The described method of operating a heat exchange system can therefore be carried out with the heat exchange system. The heat exchange system comprises:

a heat exchanger, wherein an outer boundary of the heat exchanger is formed by an inflow surface and by an outflow surface such that, in the operating state, for the exchange of heat between a transport fluid and a heat transfer fluid flowing through the heat exchanger, the transport fluid can be supplied to the heat exchanger over the inflow surface, can be brought into flow contact with the heat exchanger and can be led off again out of the heat exchanger over the outflow surface;

a fan which is configured and arranged such that the transport fluid can be transported through the heat exchanger over the inflow surface to the outflow surface;

a control unit, in particular a control unit having a data processing system, is provided so that the control unit receives one or more actual values from the heat exchanger and/or fan in the operating state and one or more desired values of the heat exchanger and/or of the fan can be adjusted by the control unit.

The heat exchange system further comprises a communication module, with the communication module being in signal communication with the control unit, the communication module receiving one or more actual values from the control unit and/or with one or more desired values being able to be transmitted from the communication module to the control unit.

The communication module is in addition in signal communication with a communication unit at least at times, with the communication unit receiving operating data in the form of one or more actual values from the communication module and/or with one or more desired values being able to be adjusted at the communication unit and one or more desired values being able to be transmitted from the communication unit to the communication module.

The communication module can in this respect be formed as a unit of the control unit. The communication unit can be in wireless signal communication with the communication module.

It is a great advantage of the heat exchange system in accordance with the invention that one or more actual values can be received and represented by the communication unit and that one or more desired values can be adjusted at the communication unit and the adjusted desired values, in particular different operating modes, can be transmitted to the control unit and taken over by it. Unnecessary costs can thereby be spared by the utilization of communication units which are present, adjustments do not have to be carried out directly at the heat exchange system; for example remote analysis and remote servicing, but also operating software (firmware) updates, can be adjusted through the communication unit via the access point and/or via the communication module at the heat exchange system, in particular through the control unit.

Heat exchange systems, e.g. cold stores whose refrigerated product spoils after a short time or e.g. supermarkets which are in the desert and heat up to unacceptable temperatures immediately or, however, e.g. computer centers in which the heat exchange system has to be immediately available again since otherwise costs arise and damage is caused to the information technology, can thus be advantageously monitored, serviced and adjusted simply, fast and inexpensively. The service technician or also a technical expert, for example a graduate engineer or a technician, can thus be immediately available. They can advantageously carry out adjustments at the heat exchange system, in particular at the control unit, simply from a remote location and inexpensively, without having to travel and wirelessly, for example by WLAN or by a remote connection, using a smartphone, a tablet, a laptop or desktop computer. Independently of whether the heat exchange system is difficult to access and is located, for example, on a roof or in the desert, savings at the heat exchange system are possible and fast response times of the service technician are possible.

Large industrial or commercial heat exchange systems whose operation and servicing are critical in time and have safety aspects can be adjusted and serviced fast and simply by service technicians even when they are always underway, for example in the case of an emergency, and when no corresponding technical devices are available such as underway or at an airport. This was not possible in this way with the previous heat exchange systems. The very complex and/or expensive recruiting of service technicians at expensive terms on site is thus also dispensed with so that costs are spared. A simple and inexpensive operation of the heat exchange system is thereby made possible by a simple method. The method of operating a heat exchange system and the heat exchange system as such are thus improved overall in comparison with the prior art.

Further advantageous measures and preferred method routines result from the dependent claims.

BRIEF DESCRIPTION OF THE DRAWINGS

Referring now to the attached drawings which form a part of this original disclosure.

DETAILED DESCRIPTION OF THE EMBODIMENTS

Figure 1:
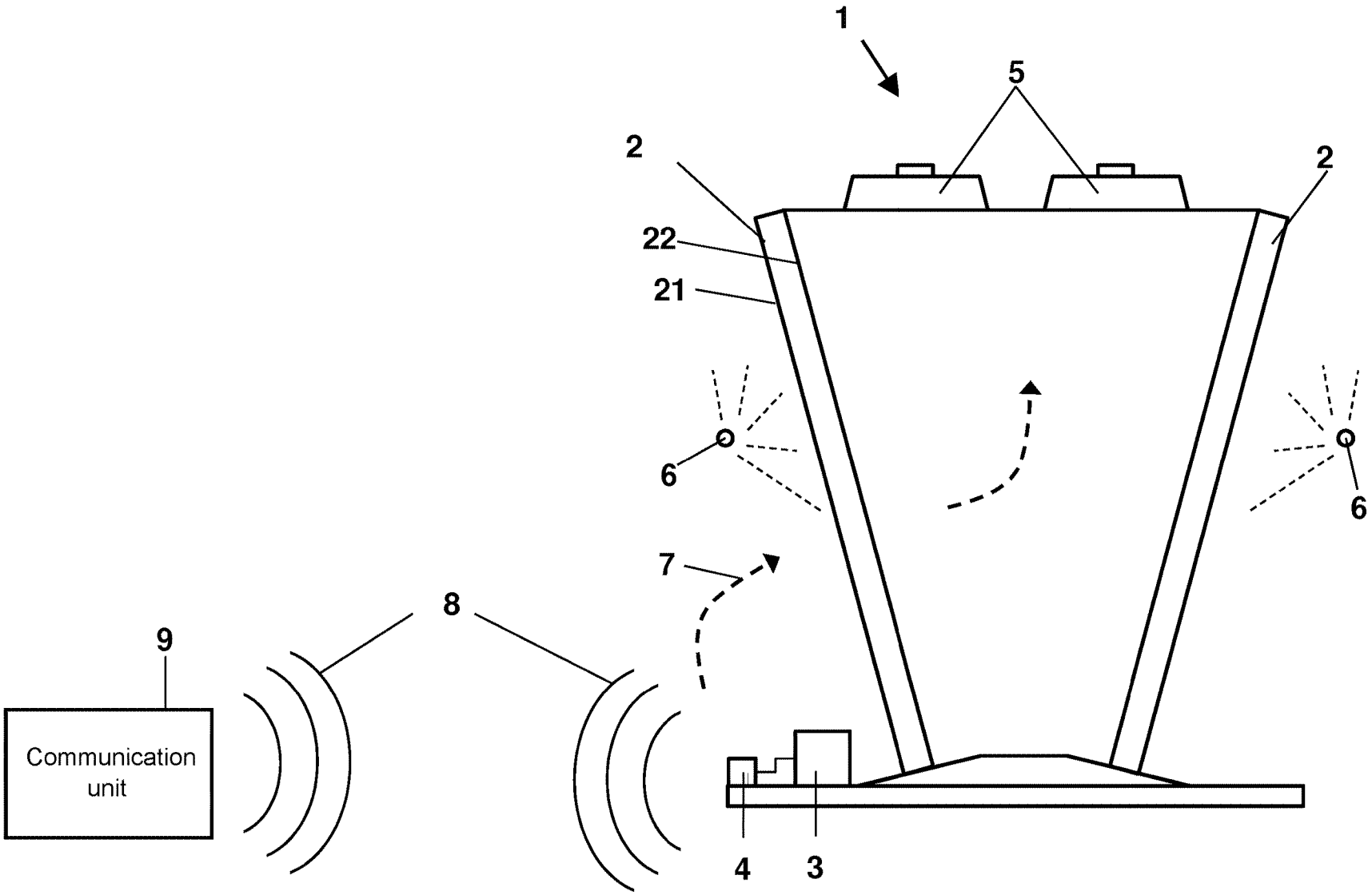
FIG. 1 is a first embodiment of a heat exchange system in accordance with the invention.

FIG. 1 shows a schematic representation of a first embodiment of a heat exchange system 1 in accordance with the invention. The heat exchange system 1 comprises a heat exchanger 2, wherein an outer boundary of the heat exchanger 2 is formed by an inflow surface 21 and by an outflow surface 22 such that, in the operating state, for the exchange of heat between a transport fluid and a heat transfer fluid flowing through the heat exchanger 2, the transport fluid can be supplied to the heat exchanger 2 over the inflow surface 21, can be brought into flow contact with the heat exchanger 2 and the transport fluid can be led off again out of the heat exchanger 2 over the outflow surface 22. The heat exchange system 1 additionally comprises a fan 5 which is configured and arranged such that the transport fluid can be transported through the heat exchanger 2 over the inflow surface 21 to the outflow surface 22 and a control unit 3, in particular a control unit 3 having a data processing system, so that the control unit 3 receives one or more actual values from the heat exchanger 2 and/or fan 5 in the operating state and that one or more desired values of the heat exchanger 2 and/or of the fan 5 can be adjusted by the control unit 3. A flow path 7 of the transport fluid is likewise shown in FIG. 1; it can be seen in this respect how the transport fluid can be transported through the heat exchanger 2 due to the fan 5. The heat exchange system 1 further comprises a communication module 4, wherein the communication module 4 is in signal communication with the control unit 3, the communication module 4 receives one or more actual values from the control unit 3 and/or one or more desired values can be transmitted from the communication module 4 to the control unit 3. The communication module 4 is furthermore in signal communication with a communication unit 9 at least at times, wherein the communication unit 9 receives operating data in the form of one or more actual values from the communication module 4 and/or one or more desired values can be adjusted at the communication unit 9 and one or more desired values can be transmitted from the communication unit 9 to the communication module 4. The communication module 4 can in this respect be formed as a unit of the control unit 3. The communication unit 9 can be in wireless signal communication 8 with the communication module 4. The heat exchanger 2 in the first embodiment shown is a fin heat exchanger but can also be a microchannel heat exchanger. The heat exchange system can also comprise a wetting device 6 for providing a wetting fluid, wherein the heat exchange system 1, in particular the heat exchanger 2, can be wetted by the wetting device 6.

The control unit 3 can receive one or more actual values from the heat exchange system 1, in particular from the heat exchanger 2 and/or fan 5 and/or environment, and one or more desired values of the heat exchange system 1, in particular of the heat exchanger 2 and/or of the fan 5, can be adjusted by the control unit 3. With the control unit 3, actual values can be received, for example from one or more sensors (not shown), with which the actual values can, for example be measured or calculated. The control unit 3 can, however, also receive further actual values, for example from further sensors or from a further control unit. By using the control unit 3, however, desired values can also be transmitted, for example to one or more actuators (not shown) with which the desired values are adjusted, that is controlled and regulated. The control unit 3 can, however, also transmit desired values to further actuators or to a further control unit.

Figure 2:
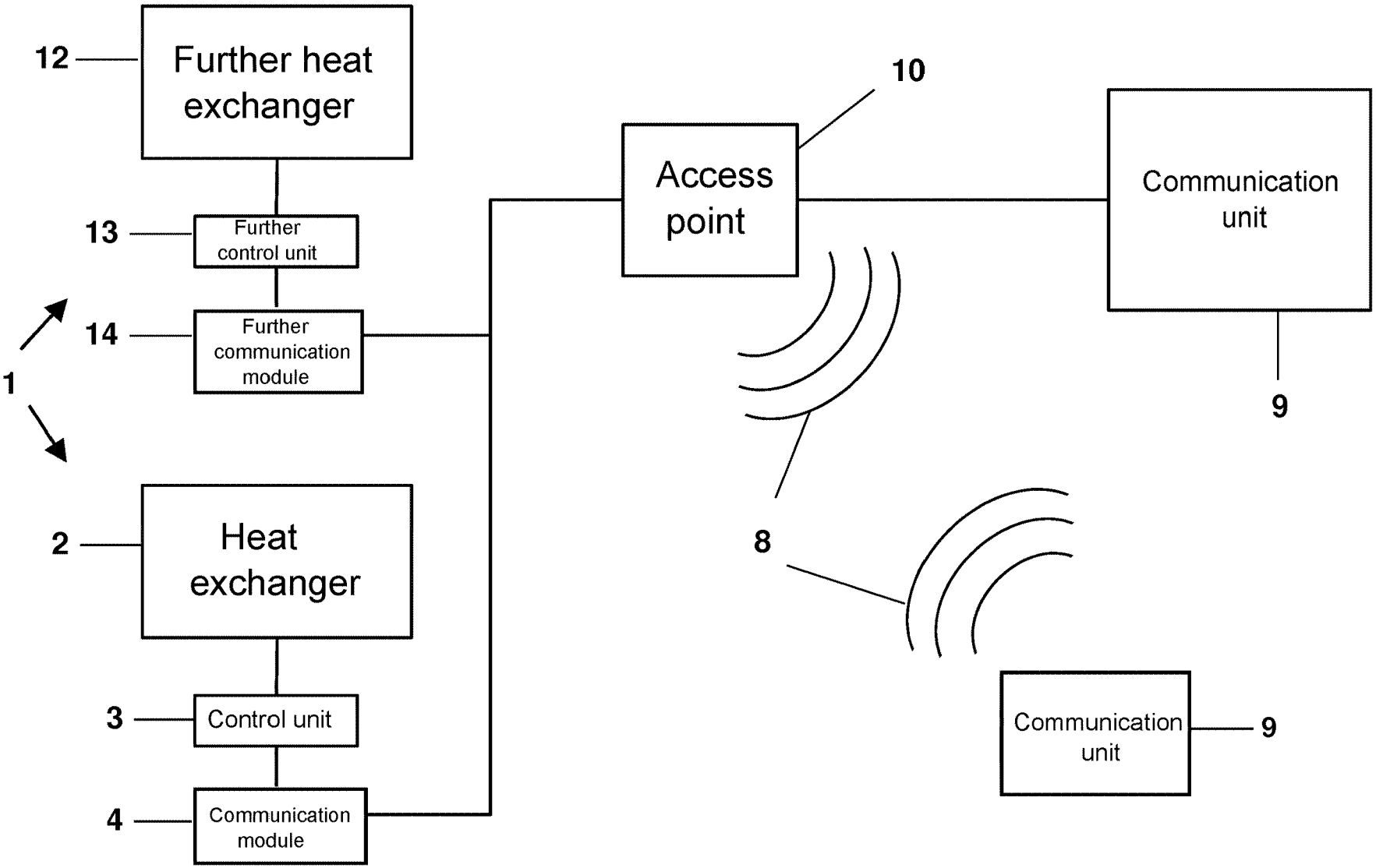
FIG. 2 is a second embodiment of a heat exchange system in accordance with the invention.

A schematic illustration of a second embodiment of a heat exchange system 1 is shown in FIG. 2. FIG. 2 substantially corresponds to FIG. 1 so that only the differences will be looked at. The communication module 4 is in signal communication, in particular in wireless signal communication, with an access point 10 and the communication unit 9 is in signal communication, in particular in wireless signal communication 8, with the access point 10 at least at times. The access point 10 receives one or more actual values from the communication module 4 and transmits one or more desired values to the communication module 4. The communication unit 9 receives one or more actual values from the access point 10, one or more desired values can be adjusted at the communication unit 9 and one or more adjusted desired values are transmitted from the communication unit 9 to the access point 10. One or more actual values and desired values can be stored at the access point. As is shown in FIG. 2, the heat exchange system 1 comprises a further heat exchanger 12, a further fan (not shown), a further control unit 13 and a further communication module 14, wherein the further communication module 14 is likewise in signal communication with the access point 10, the access point 10 receives one or more actual values from the further communication module 14 and one or more desired values are transmitted from the access point 10 to the further communication module 14.

The one or more desired values comprise a desired number of rotations for the fan and/or a first desired temperature value for the heat transfer fluid and/or a second desired temperature value for the transport fluid and/or a desired time interval for an operating time of the heat exchange system and/or an operating mode of the heat exchange system.

The method in accordance with the invention of operating a heat exchange system 1 and the measures described in the dependent claims can be carried out with the described heat exchange system 1.

The invention claimed is:

1. A method of operating a heat exchange system including a heat exchanger having an outer boundary formed by an inflow surface and an outflow surface, the method comprising:

in an operating state, exchanging heat between a transport fluid and a heat transfer fluid flowing through the heat exchanger by supplying the transport fluid to the heat exchanger over the inflow surface, so as to be brought into flow contact with the heat exchanger and to be led out of the heat exchanger over the outflow surface, the heat exchanger being operated in a thermal power range of 5 kW to 5,000 kW;

operating a fan such that the transport fluid is transported through the heat exchanger over the inflow surface to the outflow surface;

operating with a controller the heat exchanger and the fan at respective set point values;

receiving at the controller one or more actual values from at least one of the heat exchanger and the fan in the operating state;

receiving at a communication module, the communication module being a first communicator in signal communication with the controller, at least one of the one or more actual values and at least one of the set point values from the controller;

transmitting by the first communicator, in signal communication at least at times with a communication unit, the communication unit being a second communicator, the at least one of the one or more actual values and at least one of the set point values to the second communicator;

adjusting at the second communicator one or more of the set point values;

transmitting the one or more adjusted set point values from the second communicator to the first communicator;

transmitting the one or more adjusted set point values from the first communicator to the controller; and adjusting, by the controller, at least one of the heat exchanger and the fan to operate at the adjust adjusted set point values.

2. A remote heat exchange system for carrying out a method in accordance with claim 1.

3. The method in accordance with claim 1, wherein the second communicator is in wireless signal communication with the first communicator.

4. The method in accordance with claim 1, wherein the first communicator is in signal communication with an access point and the second communicator is in signal communication with the access point at least at times.

5. The method in accordance with claim 4, wherein the access point receives the one or more actual values from the first communicator and the one or more predetermined values are transmitted to the first communicator and the second communicator receives the one or more actual values from the access point and the one or more predetermined values are adjusted at the second communicator and the one or more predetermined values are transmitted from the second communicator to the access point.

6. The method in accordance with claim 4, wherein at least one of the one or more actual values and the predetermined values are stored at the access point.

7. The method in accordance with claim 4, wherein the heat exchange system comprises a further heat exchanger, a further fan, a further controller control unit and a further first communicator, with the further first communicator being in signal communication with the access point, the access point receiving the one or more actual values from the further first communicator and the one or more predetermined values being transmitted from the access point to the further first communicator.

8. The method in accordance with claim 4, wherein the one or more predetermined values comprise at least one of a predetermined number of rotations for the fan;

a first predetermined temperature value for the heat transfer fluid;

a second predetermined temperature value for the transport fluid;

a predetermined time interval for an operating time of the heat exchange system; and an operating mode of the heat exchange system.

9. The method in accordance with claim 4, wherein the controller comprises a PI regulator and the one or more predetermined values comprise a regulating portion of the PI regulator.

10. The method in accordance with claim 4, wherein the heat exchange system comprises a wetting unit, the controller receives the one or more actual values from the wetting unit in the operating state and the one or more predetermined values are adjusted by the controller at the wetting unit.

11. The method in accordance with claim 7, wherein the controller and the further controller are in signal communication.

12. The method remote heat exchange system in accordance with claim 2, wherein the first communicator is a unit of the controller.

13. The remote heat exchange system in accordance with claim 2, wherein the second communicator is arranged to adjust the one or more set point values, and further arranged to transmit the one or more adjusted set point values to the first communicator.

14. The method in accordance with claim 1, wherein the first communicator is in wireless signal communication with an access point and the second communicator is in wireless signal communication with the access point at least at times.

15. The remote heat exchange system in accordance with claim 2, wherein the controller includes a data processor.

16. The method in accordance with claim 7, wherein the controller and the further controller are in wireless signal communication.

* * * * *